US006336303B1

(12) United States Patent
Vandeman et al.

(10) Patent No.: US 6,336,303 B1
(45) Date of Patent: Jan. 8, 2002

(54) INJECTION MOLDED EXTERIOR SIDING PANEL WITH POSITIONING RELIEF AND METHOD OF INSTALLATION

(75) Inventors: Ronald L. Vandeman; Timothy M. Sauer, both of Henderson, KY (US)

(73) Assignee: Atlantis Plastics, Inc., Elkhart, IN (US)

( * ) Notice: Subject to any disclaimer, the term of this patent is extended or adjusted under 35 U.S.C. 154(b) by 0 days.

(21) Appl. No.: 09/307,457

(22) Filed: May 7, 1999

(51) Int. Cl.[7] ..... B44F 7/00

(52) U.S. Cl. ..... 52/520; 52/525; 52/547; 52/555; 52/313; 52/314

(58) Field of Search ..... 52/313, 314, 520, 52/525, 526, 539, 543, 546, 547, 551, 555, 558

(56) References Cited

U.S. PATENT DOCUMENTS

| | | | |
|---|---|---|---|
| 3,309,831 | A | 3/1967 | Misch et al. |
| 4,096,011 | A | 6/1978 | Sanders et al. |
| 4,201,024 | A | 5/1980 | Lafitte, Jr. |
| 4,229,916 | A | 10/1980 | White |
| 4,251,967 | A | 2/1981 | Hoofe, III |
| 4,290,248 | A | 9/1981 | Kemerer et al. |
| 4,308,702 | A | 1/1982 | Rajewski |
| 4,476,661 | A | 10/1984 | Hoofe, III |
| 4,598,522 | A | 7/1986 | Hoofe, III |
| 4,680,911 | A | 7/1987 | Davis et al. |
| 4,953,537 | A | 9/1990 | Allegro |
| 5,076,037 | A | 12/1991 | Crick et al. |
| 5,224,318 | A | 7/1993 | Kemerer |
| 5,249,402 | A | 10/1993 | Crick et al. |
| 5,295,339 | A | 3/1994 | Manner |
| 5,347,784 | A | 9/1994 | Crick et al. |
| 5,388,381 | A | 2/1995 | Bilinski et al. |
| 5,461,839 | A | 10/1995 | Beck |
| 5,526,627 | A | 6/1996 | Beck |
| 5,600,971 | A | 2/1997 | Suk |
| 5,615,523 | A | 4/1997 | Wells et al. |
| 5,630,305 | A | 5/1997 | Hlasnicek |
| 5,636,481 | A | 6/1997 | De Zen |
| 5,711,126 | A | 1/1998 | Wells |
| 5,735,099 | A | 4/1998 | Anderson |

*Primary Examiner*—Carl D. Friedman
*Assistant Examiner*—Phi Dieu Tran A
(74) *Attorney, Agent, or Firm*—Baker & Daniels

(57) ABSTRACT

A siding panel and two methods of installing a wall covering made from injection molded materials and having positioning relief to facilitate installation. The siding panel includes a plurality of decorative elements formed with a top edge disposed above a row of decorative elements. Apertures are formed in the panel below the top edge and on the rear side of the siding panel. The panel includes a plurality of tabs, each narrower than the apertures to provide the positioning relief, which depend downward from the rear side, with the tabs being spaced in intervals corresponding to the apertures. The decorative elements are arranged in upper and lower rows which are offset to define relatively discontinuous side edges. The panel is formed from polypropylene, and the decorative elements comprise a simulated wood grain finish to be used as cedar shake shingles. The tab is about one half the width of each aperture, with the apertures being disposed through the siding panel at an angle extending downward. The panel also includes a second pair of tabs disposed on the rear of each of the upper and lower rows of decorative elements on the side edge to define a pair of discontinuous grooves. A pair of tongues extend from the other side edge, with the grooves structured and arranged for receiving tongues of a horizontally adjacent panel, with the tongues being longer than the second pair of tabs.

28 Claims, 5 Drawing Sheets

INJECTION MOLDED EXTERIOR SIDING PANEL WITH POSITIONING RELIEF AND METHOD OF INSTALLATION

BACKGROUND OF THE INVENTION

1. Field of the Invention

The field of the present invention relates to decorative exterior wall coverings. In particular, the present invention relates to injection molded siding panels that have improved, integrally formed attachment elements that facilitate easier installation.

2. Background Art

Many types of exterior wall panels are currently known and used in the construction and improvement of residential, commercial, industrial, and other buildings. Typically, such panels are formed from a lightweight composite plastic material and are manufactured using conventional extrusion molding, injection molding, impression molding, and thermotorminy processes. Such panels may be formed in various shapes, such as individual elongated sections similar to standard aluminum siding, or single panels incorporating one or more rows of individual decorative elements. These single panels are often connected to other previously installed, identical panels through a vertical attachment and a horizontal attachment by which portions of the panel to be installed overlap portions of previously installed panels.

Prior known panel designs employ vertical side and horizontal bottom connections that must both be viewed and fitted simultaneously by the installer during installation. A problem with these designs is that the installation of such panels is difficult because the installer can only view one connection at a time. Often the installer will attempt to circumvent this problem by first connecting only the vertical side or the horizontal bottom, only to discover that the remaining connection either cannot then be attached, or will cause the initial connection to slip out of place.

In addition, prior known panel designs have both side and bottom connections that require a precise fit. Installation of these panels with such precise connections is difficult for several reasons. For example, often an entire row of connections must be attached along the vertical side or horizontal bottom of a panel, necessitating frequent checking and adjusting as the panel is maneuvered into its installed position. Also, this problem is exacerbated by the need for such panels to overlap in order to conceal their attachment points because such connections are hidden from the installer as they are attached during installation. The installer is often forced either to position his head in an awkward viewing position near the wall surface when fitting the panel into position, or even to blindly "feel" the panel into position with his hands by fitting each connection without actually viewing the connections as they are attached. In addition, this difficulty is further exacerbated when the vertical side and horizontal bottom connections have to be viewed simultaneously when attached, as described above.

Further, prior panels have employed fastener attachments located on the rear of the panel that have no logical relation to reference elements on the front side of the panel. For example, one prior design comprises a series of tabs spaced at intervals on the rear side of the panel that do not correspond to the arrangement of any elements or reference points on the front side. This problem hampers installation because, as described above, those elements are hidden from the installer during installation, and the installer cannot, by simply looking at the front of the panel, identify the locations of the attachment elements on the rear of the panel.

Prior known panel designs have also employed connections that lock firmly into place upon attachment. A problem with such connections is that they are rigid, and cannot accommodate the inevitable movement associated with thermal expansion or the settling of the underlying wall surface after the panels are installed.

Finally, prior panel designs have been difficult to cut, trim, or otherwise adjust to fit into tight areas along a wall surface, such as within the gable of a roof line, or the area surrounding windows and other surface irregularities. Some existing panels may only be cut in certain structurally designated locations without compromising their overall structural integrity. Other panels are made of materials that are difficult to cut, occasionally requiring certain types of saws and saw blades.

SUMMARY OF THE INVENTION

The present invention provides an exterior siding panel with positioning relief comprised of external rows of decorative elements that may be used in conjunction with other panels to form a continuous sided surface along a wall. Along the top of each panel relatively wide rectangular apertures are spaced at intervals to receive relatively narrow complimentary tabs spaced on the lower rear portions of an overlapping panel to provide positioning relief. The sides of the panels are also connected by a discontinuous, tongue-and-groove apparatus where one connection is made on the side edge of the lower row of elements and a second connection is made on the side edge of the upper row of elements. These two side connections connections fit over an area of overlap, with one side of the panel underlying an overlapping portion on an adjacent complimentary panel.

The relatively wider receiving apertures on an installed panel provide a free lateral pace, allowing a wider margin for the insertion of the relatively narrower tabs on the lower rear portion of the panel being installed, as the installer cannot directly view these connections as they are effected. These relatively wide receiving apertures are disposed through the panel at an angle that slopes downward from the front side of the panel to the rear side. This angle allows the tabs of an overlapping panel to pass horizontally through the apertures while simultaneously accommodating the vertical downward movement of the tabs behind the rear panel surface. This aids installation by eliminating the two step process that would be necessitated by a horizontally level aperture, comprising a first step of pushing the tabs horizontally through the apertures, followed by a second vertical downward shifting of the panel to move the tabs downward behind the rear surface of an underlying panel.

The tongue-and-groove apparatus, although partially hidden from the installer during installation, allows for the easier side attachment of horizontally adjacent panels because it consists of only two complimentary connections. The tongue-and-groove apparatus further provides for easier installation because the tongues on the sides of the panels are longer than the complimentary grooves on adjacent connecting panels. This eliminates the need to fit the tongues into the grooves along the entire length of the tongues.

The relatively narrow tabs on the rear of the panel are each located directly behind the center of a decorative element. Therefore, although these tabs are necessarily hidden from the installer during installation, the installer, by simply viewing the decorative elements on the front side, can identify precisely where each tab on the rear side is located.

The horizontal tab and aperture connections and the vertical tongue-and-groove connections are not firmly or rigidly attached, and can accommodate shifting and other movement of the panels along the attachment points, while still maintaining the overall connections of the panels on the wall surface. These attachment methods provide a wall covering comprised of a plurality of panels that is more resistant to the shifting of the panels after installation due to thermal expansion or the settling of the underlying wall surface.

The panels may be installed by either of two methods. The first method eliminates the need to make simultaneous horizontal and vertical connections. Using this method, first the relatively narrow tabs on the bottom rear of a panel are inserted vertically directly downward into the relatively wider rectangular apertures in a second previously installed lower panel, bringing the panel to rest on top of the previously installed lower panel. The grooves of the panel are automatically aligned with the tongues of a horizontally adjacent, previously installed third panel when the panel is resting on the previously installed lower panel. The panel is then shifted directly horizontally, engaging the tongue-and-groove connections with the horizontally adjacent third panel.

The second installation method allows the panels to be mounted onto previously installed panels from a variety of approach angles without requiring the installer to view two simultaneous connections. The panel is installed by first initially inserting the tongues of the panel into the corresponding side grooves of a previously installed, horizontally adjacent panel. The installer then rocks the panel into position by rotating the panel in a clockwise direction, and inserting the relatively narrow tabs on the lower rear of the panel into the relatively wider apertures along the upper front of a vertically adjacent panel while completing the insertion of the tongue of the panel into the groove of the horizontally adjacent panel. The installer need only view the side tongue-and-groove connection because the free lateral space provided by the relatively wider receiving apertures in the vertically adjacent lower panel accommodate the wider range of motion of the tab.

Finally, the panels can be easily manufactured using known injection molding processes and comprise a single piece of injection molded material. The panels are composed of a rigid, firm composition that is resistant to impacts on the front side of the panel after installation, yet is capable of being easily cut during installation using most standard saw blades along horizontal, vertical, or diagonal directions without cracking, shattering or otherwise damaging the panel. This ability to be cut in any location allows the panels to be custom fit to cover awkward or cramped areas of a wall surface such as the gable of a roof line, or around and between windows, doors, and other surface irregularities. The synthetic composition of the panel is weather-resistant, does not require painting, and the synthetic composition further prevents the panel from acting as a host for termites, carpenter ants, or other pests.

In one form, the present invention is a siding panel comprising decorative elements, apertures, and tabs. The decorative elements are formed with the panel and disposed in at least one row, defining a front face of the siding panel. A top edge is disposed above a row of decorative elements. The apertures are formed in said panel and disposed below the top edge and on a rear side of said siding panel. The tabs are each narrower than the apertures to provide positioning relief, with the tabs formed with the panel depending downward from the rear side and spaced in intervals corresponding to the apertures.

In another form, the present invention is a plurality of siding panels forming siding for a building. Each panel comprises horizontal upper and lower edges, and vertical first and second lateral side edges offset such that the side edges are discontinuous. Apertures are disposed beneath the upper edges spaced at intervals, and tabs which are narrower than the apertures depend downward and are disposed above the lower edges being spaced at intervals complimentary to the apertures. Also, side tabs are disposed on a side edge, the side tabs defining discontinuous groove spaces. Tongues extend from the other side edge to engage the side tabs.

In another form, the present invention relates to a method of installing a wall covering formed of plurality of horizontal courses of siding panels. This method involves first installing first and second panels relatively diagonally so the first panel is lower and laterally offset from the second panel. Next, a third panel is installed by a series of steps: (A) inserting tabs on the rear the front face of the third panel into apertures of the first lower panel then shifting the third panel horizontally, engaging grooves of the third panel with tongues of the second laterally adjacent panel; or (B) initiating engagement of grooves of the third panel with tongues of the second laterally adjacent panel and concurrently inserting tabs on the rear of the third panel into apertures of the first lower panel, while concurrently completing engagement of grooves of the third panel with tongues of the second laterally adjacent panel.

BRIEF DESCRIPTION OF THE DRAWINGS

The above mentioned and other features and objects of this invention, and the manner of attaining them, will become more apparent and the invention itself will be better understood by reference to the following description of an exemplary embodiment of the invention taken in conjunction with the accompanying drawings, wherein.

Figure 1:
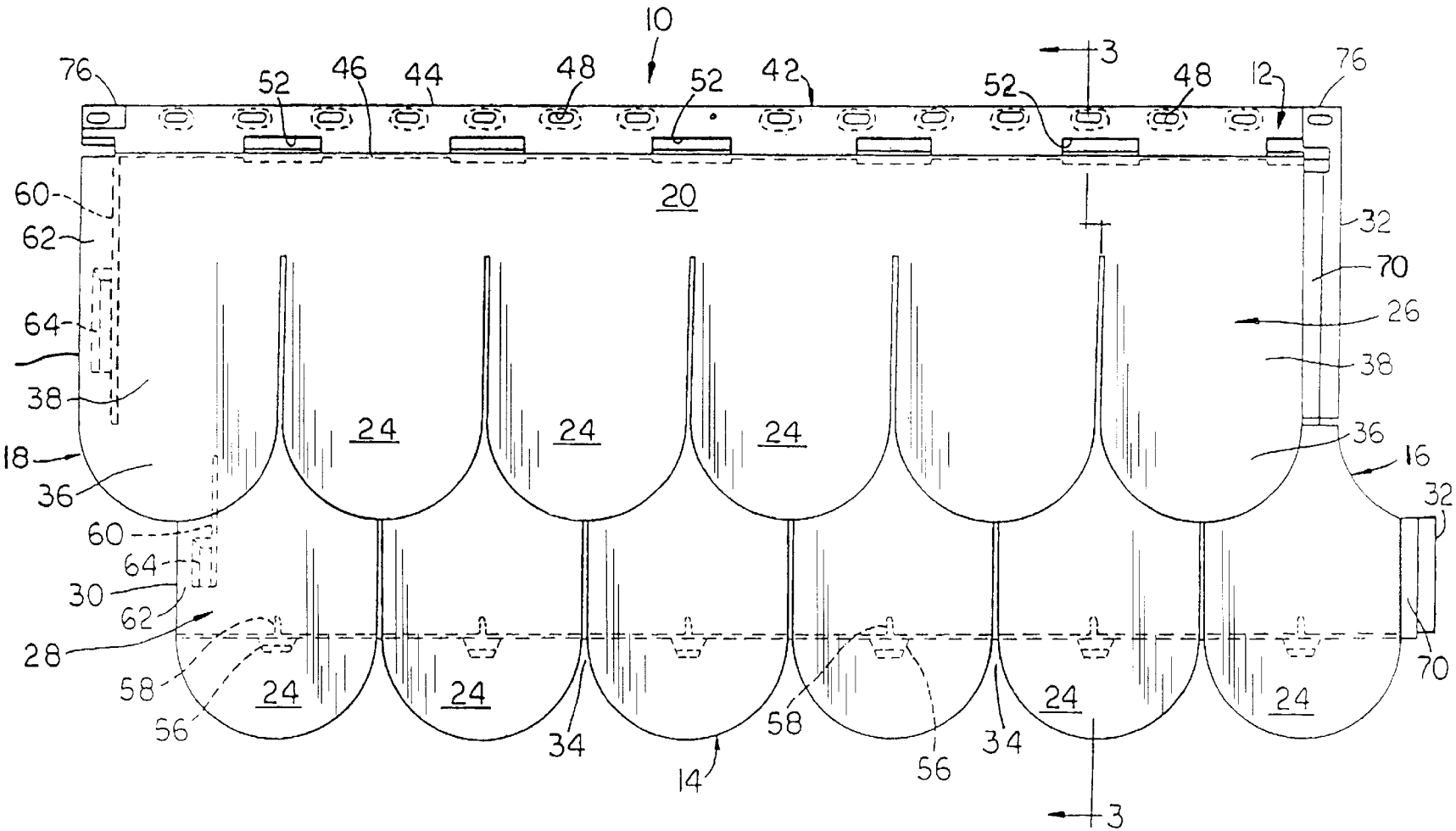
FIG. 1 is a front elevation of a panel illustrating the relatively wide rectangular apertures and the tongues along the right edge, and also showing in dashed lines both the relatively narrow tabs near the lower edge, and the tabs on the rear of the panel near the left side that define the grooves along the left edge.

Corresponding reference characters indicate corresponding parts throughout the several views. Although the drawings represent an exemplary embodiment of the present invention, the drawings are not necessarily to scale and certain features may be exaggerated in order to better illustrate and explain the present invention. The exemplification set out herein illustrates an exemplary embodiment of the invention, in one form, and such exemplification is not to be construed as limiting the scope of the invention in any manner.

DETAILED DESCRIPTION OF THE INVENTION

The exemplary embodiment disclosed below is not intended to be exhaustive or limit the invention to the precise forms disclosed in the following detailed description. Rather, the exemplary embodiment is chosen and described so that others skilled in the art may utilize its teachings.

The present invention provides injection molded exterior siding panels that facilitate easier installation by incorporating relatively wide rectangular apertures along the top of each panel to receive relatively narrow complimentary tabs spaced on the lower rear of an overlapping second panel, as well as a side attachment comprising a discontinuous tongue-and groove-apparatus.

Figure 2:
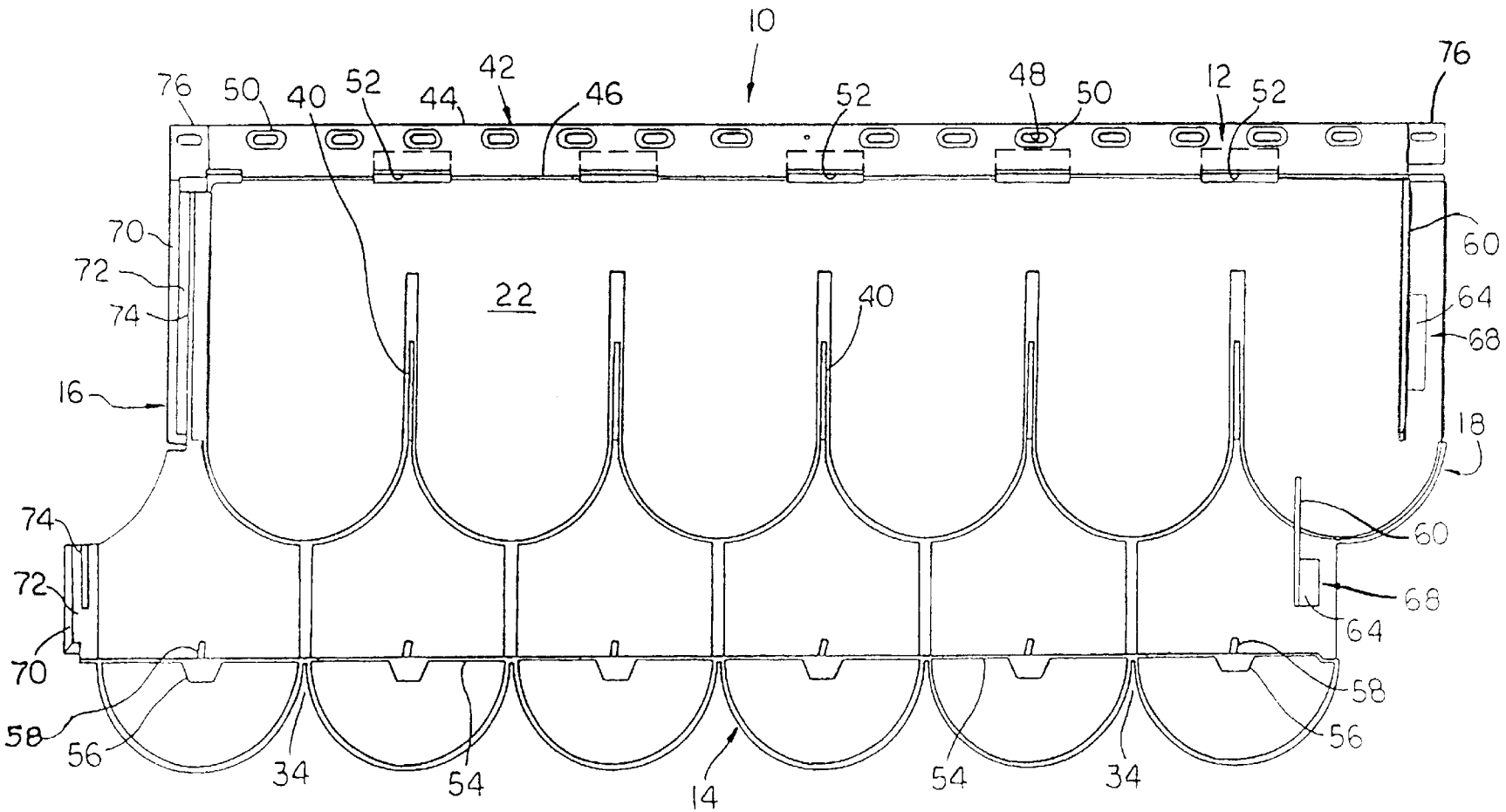
FIG. 2 is a rear elevation of a panel illustrating the relatively wide rectangular apertures, the tongues along the left edge, the relatively narrow tabs near the lower edge, and the groove connections along the right edge.

The structure of the inventive panels is depicted in FIGS. 1 and 2, showing front and rear elevations of such a panel. Panel 10 comprises top portion 12, bottom portion 14, right side portion 16, and left side portion 18. Along front side 20 of panel 10, decorative elements 24 are arranged in upper row 26 and lower row 28. However, further embodiments in the form of panels comprising only a single row of decorative elements 24 or three or more rows of decorative elements 24 may be designed in accordance with the present invention as hereinafter described. Returning to the exemplary embodiment, upper row 26 and lower row 28 of decorative elements 24 are offset, resulting in a discontinuous left edge portions 30 and a discontinuous right edge portions 32 of panel 10. Decorative elements 24 which are depicted in FIGS. 1 and 2 show an un-ornamental smooth facing; however, decorative elements 24 may also comprise simulated cedar shake shingles or other types of shingles with simulated wood grain finish. Between adjacent decorative elements 24 are gaps 34 of uniform thickness. Decorative elements 24 are disposed such that the bottom portion 36 of each decorative element 24 is spaced further away from the wall surface (not shown) than the top portion 38 of each decorative element 24 when panel 10 is installed. This results in the appearance of overlap of each successive upper row 26 of decorative elements 24 over an adjacent lower row 28 of decorative elements 24. As may be seen in FIG. 2, support ridges 40 between each decorative element 24 on the upper row 26 fit against the wall surface (not shown) and support panel 10 against the wall surface.

Panel 10 is manufactured using a customary injection molding process, and comprises a single piece of injection molded material, for example polypropylene or polyvinyl chloride (PVC). Generally, panel 10 is formed of a composition that will provide a firm, rigid panel resistant to impacts on front side 20, yet is able to accommodate flexing, such as bending or bowing. Panel 10 is also formed of a non-brittle composition that is resistant to cracking or fracturing, and therefore able to withstand cutting along horizontal, vertical, or diagonal directions during installation. For example, one suitable material includes polypropylene, a blend of copolymer and homopolymer resins, filled with calcium carbonate and ultraviolet (UV) stabilizer.

Referring again to FIGS. 1 and 2, top portion 12 of panel 10 comprises mounting strip 42, which is disposed between top edge 44 and aperture ledge/edge 46. Spaced at intervals along the mounting strip 42 are nailing apertures 48. Nailing apertures 48 are herein illustrated in an elongated oval shape. However, nailing apertures 48 may take any shape, and need only be wider in the horizontal direction than the width of a nail (not shown) in order to accommodate the horizontal shifting movement of installed panels 10 that is generally associated with thermal expansion or the settling of the underlying wall surface. Nailing apertures 48 are bordered on the rear side 22 of panel 10 by rings 50 which are integrally formed with panel 10 and abut the wall surface. Rings 50 prevent the heads of the nails from directly pinning mounting strip 42 to the wall surface along its entire length in a flush manner when nailed into place during installation. Such pinning of mounting strip 42 to the wall surface may result in panel 10 tearing from the underlying wall surface around the head of the nail.

Also spaced along the top portion 12 of panel 10 are rectangular apertures 52. Rectangular apertures 52 are disposed below nail apertures 48 and intersect aperture edge 46 such that rectangular apertures 52 are partially disposed both within mounting strip 42 and upper row 26 decorative elements 24. Rectangular apertures 52 are spaced along top portion 12 of panel 10 such that rectangular apertures 52 are centered with respect to gaps 34 between decorative elements 24.

Referring to FIG. 2, lateral ridge 54 is disposed along the bottom portion 14 of panel 10, and is integrally formed with panel 10. Tabs 56 are spaced along lateral ridge 54 at the center of each decorative element 24 in lower row 28. Tabs 56 are integrally formed with lateral ridge 54 in a horizontal row and depend downward from lateral ridge 54. Tab supports 58 are integrally formed with tabs 56 and lateral ridge 54 and prevent tabs 56 from bending around the pivot of lateral ridge 54 toward the rear side 22 of panel 10. Tabs 56 are tapered slightly toward their ends 58 and are narrower than rectangular apertures 52. More specifically, tabs 56 are usually about one half the width of rectangular apertures 52. The difference in width between tabs 56 and rectangular apertures 52 provide a free lateral space in either horizontal direction. Therefore, when tabs 56 of a first panel are inserted into rectangular apertures 52 of a second panel, the free lateral space provides positioning relief for the mounting of panel 10 onto previously installed panels.

Referring again to FIGS. 1 and 2, vertical ridges 60 are disposed along the rear side 22 of panel 10 proximal to left edge 30. The area between vertical ridges 60 and left edge 30 defines left overlap portion 62. Integrally formed with vertical ridges 60 are tabs 64 which extend horizontally from vertical ridges 60 toward left edge 30. Tabs 64, together with left overlap portion 62 define grooves 68 with open ends facing left edge 30.

Tongues 70 extend from the discontinuous right edge 32. Tongues 70 contain tongue channels 72 which open facing the front side 20 of panel 10. Tongues 70 also contain tongue support ridges 74 which abut the wall surface (not shown) and support tongues 70 against the wall surface. Tongues 70 are longer than the corresponding tabs 64, which, together with left overlap portion 62 define grooves 68.

Figure 3:
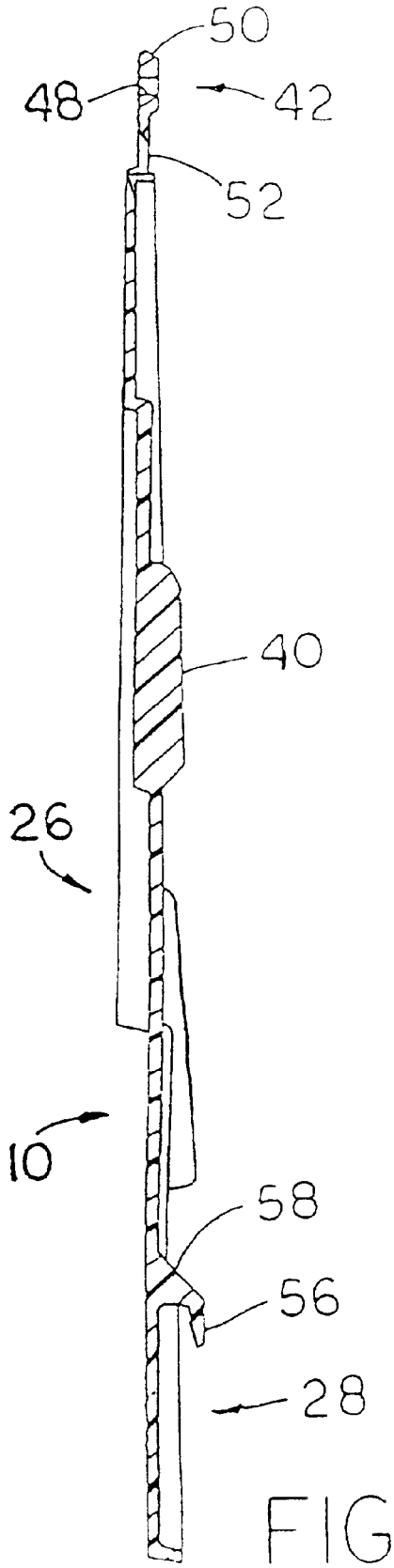
FIG. 3 is a sectional drawing taken through the line 3—3 of FIG. 1 and viewed in the direction of the arrows.

Referring to FIG. 3, it may be seen that rectangular apertures 52 are disposed through panel 10 at a generally downward angle toward the wall surface (not shown). This downward angle allows tabs 56 to be inserted both through and downward into rectangular apertures 52 in a single motion, as opposed to first inserting tabs 56 through rectangular apertures 52 followed by a second motion of tabs 56 downward behind the rear side 22 of panel 10. Nailing apertures 48 surrounded by rings 50 which abut the wall surface are also shown, disposed above rectangular apertures 52. Support ridges 40 are disposed between the decorative elements 24 of upper row 26 and support panel 10 against wall the surface (not shown). Tabs 56 are integrally formed with lateral ridge 54 and depend downward from the center of each decorative element 24 on the lower row 28.

Figure 4:
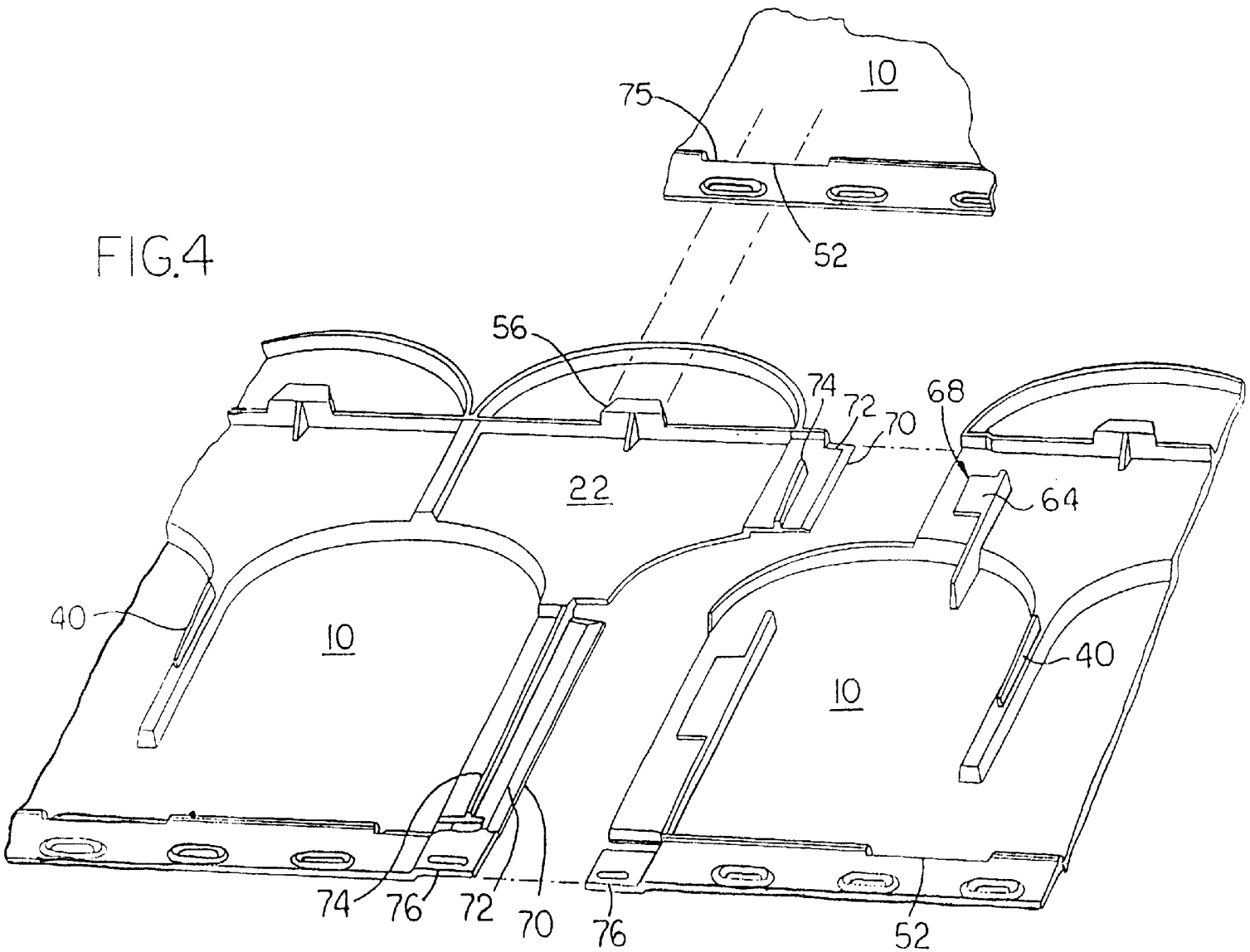
FIG. 4 is a perspective rear view of a plurality of panels installed in an interfitting manner, illustrating the side tongue-and-groove attachments.

Referring to FIG. 4, an adjoining pair of panels is shown as they would be attached in accordance with the present invention. Tabs 56 are inserted through rectangular apertures 52 and are disposed against the rear side 22 of panel 10. On either side of tabs 56 a free lateral space 75 may be seen, which allows tabs 56 to move horizontally within rectangular apertures 52 to provide positioning relief for the installation of panel 10. Tongues 70 are inserted within grooves 68. Similar to the connections of tabs 56 through rectangular apertures 52, the connections between tongues 70 and grooves 68 can accommodate horizontal movement while still maintaining an interlocking connection. Tongue support ridges 74 abut the wall surface (not shown) and support tongues 70 against the wall surface (not shown). Support ridges 40 also abut the wall surface and support panel 10 against the wall surface. End portions 76 of mounting strips 42 are offset on opposite ends of each mounting strip 42 in order to facilitate an overlapping relation. End portions 76 of mounting strips 42 also contain nailing apertures 48 which may be overlapped to receive a mounting nail driven through both nailing apertures 48.

Although both the horizontal connections comprising tabs 56 fitted within rectangular apertures 52 and the vertical connections comprising tongues 70 fitting within grooves 68 of panel 10 have been described as above, such horizontal and vertical connections may be structurally reversed. In such an embodiment, each panel (not shown) may comprise horizontal connections of tongues similar to tongues 70 mounted to and extending from the mounting strip 42 fitting within grooves similar to grooves 68 defined by tabs similar to tabs 64 mounted on the rear of lower row 28 of decorative elements 24. Such a panel may further comprise vertical connections of relatively narrow tabs similar to tabs 64 mounted on the rear of the panel proximal to the sides of both the upper row 26 and lower row 28 of decorative elements 24, fitting within rectangular apertures similar to rectangular apertures 52 disposed at intervals through left overlap portion 62, the aforementioned embodiment not departing from the scope of the present invention.

Figure 5:
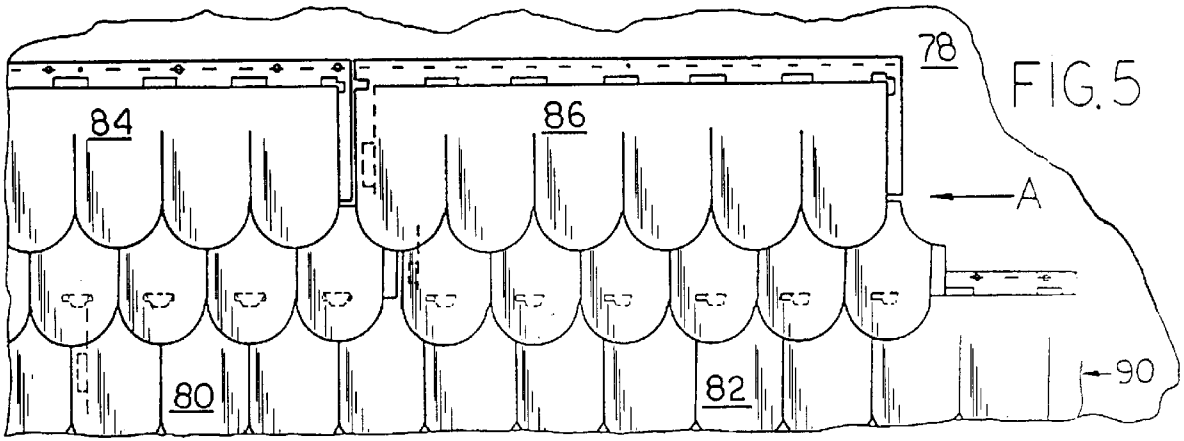
FIG. 5 is a plan view of a plurality of panels installed on a wall surface, with one panel shown separated from the others in a position illustrating a first method of installation.
Figure 6:
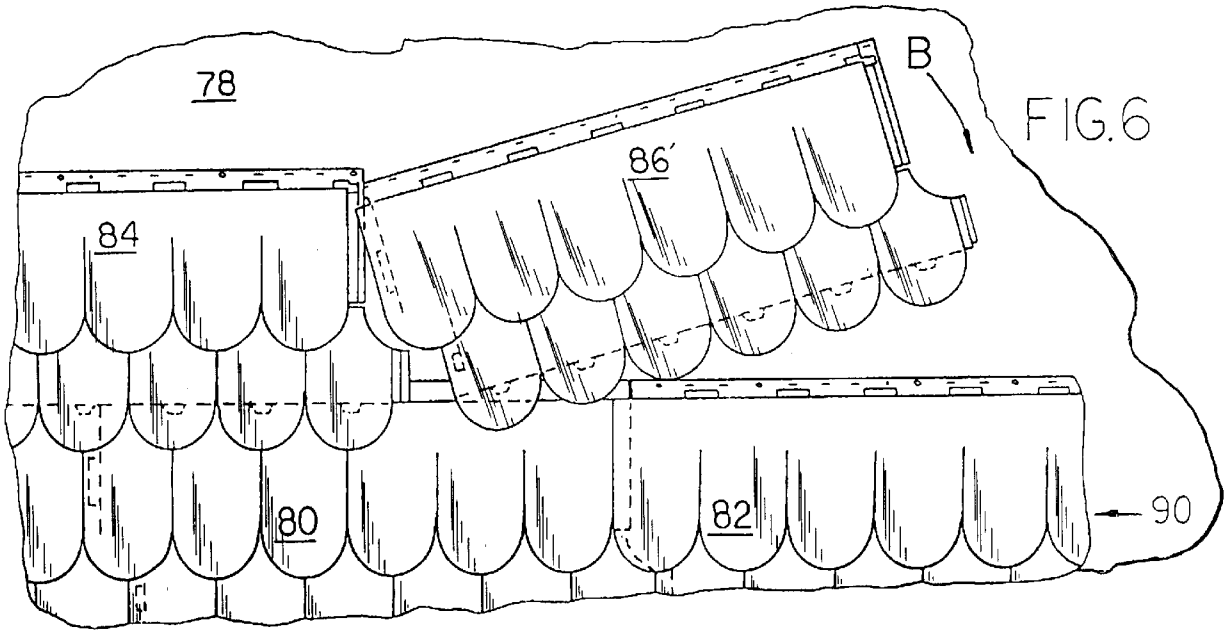
FIG. 6 is a plan view of a plurality of panels installed on a wall surface, with one panel shown separated from the others in a position illustrating a second method of installation.

Returning to the example embodiment and referring to FIGS. 5 and 6, two alternative methods of installing panel 10 are illustrated. In either method, first a starter strip (essentially comprising the structure of mounting strip 42), is nailed into place along the bottom of wall surface 78. The starter strip is comprised of an upper portion, similar to mounting strip 42 and a lower portion accommodating rectangular apertures similar to rectangular apertures 52. Beginning, for example, at the lower left comer of the wall surface 78, an initial panel 80, identical to panel 10 as illustrated in FIGS. 1, 2, 3, and 4, is cut vertically to fit flush against the left edge of the wall surface. The location on initial panel 80 at which that panel is cut vertically is determined by the discretion of the installer, as initial panel 80 may be cut at any location. Initial panel 80 is mounted on the starter strip by inserting the tabs on the rear of initial panel 80 through the rectangular apertures within the starter strip, then nailing initial panel 80 into place by driving a plurality of nails through nailing apertures of initial panel 80. Additional panels are then installed along the starter strip to effect a first course 90 of installed panels.

Referring to FIGS. 5 and 6, it will be seen that once the starter strip and initial panel 80 are installed, additional panels are installed by connecting them to previously installed panels. It will also be seen that previously installed panels 82 and 84 are disposed in a diagonal orientation, more specifically, panel 82 is disposed diagonally from panel 84, and lower and to the right of panel 84. This diagonal can be seen by reference to the rectangularly shaped wall covering comprised of panels 80, 82, and 84 where panels 82 and 84 are disposed diagonally from each other. Two alternative methods of installing new panel 86 are outlined below.

Referring to FIG. 5, a first method of installation of panel 86 is illustrated. First, the relatively narrow tabs 56 on the rear of the bottom portion 14 of panel 10 are inserted vertically downward through rectangular apertures 52 of vertically adjacent, previously installed panel 82 (and also panel 80). The positioning relief provided by the difference in width between tabs 56 and rectangular apertures 52 aids this first step of installation. In this position, panel 86 may rest upon panel 82 in a partially overlapped position, and it may be seen that side grooves 68 of panel 86 are aligned horizontally with the corresponding tongues 70 of horizontally adjacent, previously installed panel 84. Panel 86 is then shifted directly horizontally in the direction of arrow A, thereby engaging grooves 68 of panel 86 around tongues 70 of panel 84. Panel 86 is then permanently secured by driving nails through nailing apertures 48 disposed within mounting strip 42 of panel 86.

Referring to FIG. 6, a second method of installation of panel 86' is illustrated. First, grooves 68 of panel 10 are initially partially engaged around the corresponding tongues of a horizontally adjacent, previously installed panel 84. It will be seen that the tongue-and-groove attachment between panels 86' and 84 allow panel 86' to be initially installed from a variety of approach angles. Panel 86' is then rotated in a clockwise direction in the direction of arrow B, simultaneously inserting the relatively narrow tabs 56 of panel 86' through the rectangular apertures 52 of vertically adjacent, previously installed panel 82, while simultaneously completing the engagement of grooves 68 of panel 68' around the tongues 70 of panel 82. The positioning relief provided by the difference in width between the relatively wide rectangular apertures 52 and the relatively narrow tabs 56 allows panel 86' to be rotated such that the tabs 56 of panel 86' may be inserted through the rectangular apertures 52 of panel 82 without the installer being required to view such insertion. The installer therefore need only focus his attention on the engagement of grooves 68 of panel 86' around the tongues 70 of panel 84. Panel 86' is then permanently secured by driving nails through nailing apertures 48 disposed within mounting strip 42 of panel 86'.

In the exemplary embodiment of the invention tabs 56 are about one inch (1") wide and apertures 52 are about three inches (3") wide. The material of panels 10 is: polypropylene, which may include one or more of the following additives: calcium carbonate and UV stabilizer. The panel size, in the exemplary embodiment, has dimensions of approximately thirty-five and one half inches (35 ½") breath by approximately sixteen and one half inches (16 ½") height by approximately seven sixty-fourths inches (7⁄64") wall thickness.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A siding panel, comprising:

a plurality of decorative elements formed with said panel and disposed in at least one row, said decorative elements defining a front face of said siding panel;

a top edge disposed above said decorative elements;

a plurality of apertures formed in and extending through said panel disposed below said top edge of said siding panel; and a plurality of downwardly depending tabs, each narrower than said apertures to provide positioning relief, said tabs formed with said panel on said rear side, said tabs spaced in intervals corresponding to said apertures and wherein said apertures are profiled to receive said tabs of a vertically adjacent panel.

2. The panel of claim 1, wherein said decorative elements are arranged in an upper row of decorative elements and a lower row of decorative elements which are offset to define a first side edge and a second side edge that are relatively discontinuous.

3. The panel of claim 1, wherein said panel is formed from an injection molding process.

4. The panel of claim 1, wherein said panel is formed from polypropylene.

5. The panel of claim 1, wherein said decorative elements comprise simulated wood grain finish.

6. The panel of claim 1, wherein each of said tabs is about one third the width of each of said apertures.

7. The panel of claim 1, wherein said apertures are disposed through said panel at an angle extending downward from said top edge of the panel toward said decorative elements.

8. The panel of claim 2, wherein said panel further comprises:

a horizontally extending pair of tabs disposed on the rear of said decorative elements proximal to and extending toward said first side edge and together with said first side edge defining a pair of discontinuous grooves;

a pair of tongues extending from said second side edge;

said grooves structured and arranged for receiving said tongues of a horizontally adjacent panel and said tongues structured and arranged for insertion into said grooves of a horizontally adjacent panel.

9. The panel of claim 8, wherein said tongues are longer than said horizontally extending pair of tabs.

10. A plurality of siding panels forming siding for a building, each said panel comprising:

upper and lower horizontal edges;

first and second vertical side edges, each of said side edges having an offset such that said side edges are discontinuous;

a plurality of apertures disposed beneath said upper edge spaced at intervals;

a plurality of downwardly depending tabs, said tabs being narrower than said apertures, said tabs disposed above said lower edge on the rear of said panel, and spaced at intervals complimentary to said apertures;

a plurality of horizontally extending tabs disposed on the rear of said panel proximal to one of said first side edge or said second side edges, said horizontally extending tabs defining discontinuous groove spaces with the proximal first or second side edge; and a pair of tongues each extending from the other of said first side edge or said second side edge opposite the side edge proximal to said horizontally extending tabs.

11. The panels of claim 10, wherein said plurality of downwardly extending tabs of a first panel are insertable into said apertures of a lower vertically adjacent one of said panels, and said grooves of said first panel are engageable with the tongues of a horizontally adjacent one of said panels disposed laterally to said first panel.

12. The panels of claim 10, wherein said panels are formed from an injection molding process.

13. The panels of claim 10, wherein said panels are formed from polypropylene.

14. The panels of claim 10, wherein said tongues are longer than said horizontally extending tabs.

15. The panels of claim 10, wherein each of said downwardly depending tabs is about one half the width of each said aperture.

16. The panels of claim 10, wherein each said panel further comprises:

an upper row of decorative elements; and a lower row of decorative elements offset from said upper row and disposed beneath said upper row.

17. The panels of claim 16, wherein said apertures are disposed through said panel at an angle extending downward from said top edge of the panel toward said upper row of decorative elements.

18. The panels of claim 16, wherein said decorative elements comprise a simulated wood grain finish.

19. A method of installing a wall covering formed of plurality of horizontal courses of identical siding panels, comprising the steps of:

providing a plurality of panels, each comprising a plurality of decorative elements integrally formed with said panel and disposed in at least one row, said decorative elements defining a front face of said panel, a top edge disposed above said decorative elements, a plurality of apertures formed in and extending through said panel disposed below said top edge, a plurality of downwardly depending tabs each narrower than said apertures to provide positioning relief and integrally formed with said panel on the rear side, and spaced in intervals corresponding to said apertures, a pair of horizontally extending tabs disposed on a rear side opposite from said front face proximal to a first side edge and extending toward said first edge and together with said first edge defining a pair of discontinuous grooves, a pair of tongues extending from a second side edge, said grooves for receiving said tongues of a horizontally adjacent second panel and said tongues for insertion into said grooves of a horizontally adjacent third panel;

installing first and second panels such that said first panel and said second panel are disposed relatively diagonally so said first panel is lower and laterally offset from said second panel;

installing a third panel by the following series of steps:

inserting said plurality of said tabs on the rear side of said third panel into said apertures of said first lower panel; and shifting said third panel horizontally, engaging said grooves of said third panel with said tongues of said second laterally adjacent panel.

20. The method of claim 19, comprising the additional steps of:

providing a starter strip;

installing said starter strip along the bottom of a wall surface;

installing a horizontal first course of said panels including said first lower panel along said starter strip; and installing said second laterally adjacent panel above said first course of panels such that said first lower and said second laterally adjacent panels are disposed relatively diagonally.

21. A method of installing a wall covering formed of plurality of horizontal courses of identical siding panels, comprising the steps of:

providing a plurality of panels, each comprising a plurality of decorative elements integrally formed with said panel and disposed in at least one row, said decorative elements defining a front face of said panel, a top edge disposed above said decorative elements, a plurality of apertures formed in and extending through said panel disposed below said top edge, a plurality of downwardly depending tabs each narrower than said apertures to provide positioning relief and integrally formed with said panel on the rear side, and spaced in intervals corresponding to said apertures, a pair of horizontally extending tabs disposed on a rear side opposite from said front face proximal to a first side edge and extending toward said first edge and together with said first edge defining a pair of discontinuous grooves, a pair of tongues extending from a second side edge, said grooves for receiving said tongues of a horizontally adjacent second panel and said tongues for insertion into said grooves of a horizontally adjacent third panel;

installing first and second panels such that said first panel and said second panel are disposed relatively diagonally so said first panel is lower and laterally offset from said second panel;

installing a third panel by the following series of steps:

initiating engagement of said grooves of said third panel with said tongues of said second laterally adjacent panel; and concurrently inserting said plurality of said tabs on the rear of said third panel into said apertures of said first lower panel, while concurrently completing said engagement of said grooves of said third panel with said tongues of said second laterally adjacent panel.

22. The method of claim 21, comprising the additional steps of:

providing a starter strip;

installing said starter strip along the bottom of a wall surface;

installing a horizontal first course of said panels including said first lower panel along said starter strip; and installing said second laterally adjacent panel above said first course of panels such that said first lower and said second laterally adjacent panels are disposed relatively diagonally.

23. A siding panel, comprising:

a plurality of decorative elements formed with said panel and disposed in at least one row, said decorative elements defining a front face of said siding panel;

a top edge disposed above said decorative elements;

a mounting strip intermediate said top edge and said decorative elements and an aperture ledge joining said mounting strip and said decorative elements;

a plurality of apertures formed in and extending through said panel disposed below said top edge and intersecting said aperture ledge of said siding panel; and a plurality of downwardly depending tabs, each narrower than said apertures to provide positioning relief, said tabs formed with said panel on a rear side, said tabs spaced in intervals corresponding to said apertures.

24. The siding panel of claim 23, further comprising a plurality of nailing openings on said mounting strip.

25. The siding panel of claim 23, wherein said apertures are disposed through said panel at an angle extending downward from said top edge of the panel towards said decorative elements.

26. The panel of claim 25, further comprising a horizontally extending pair of tabs disposed on the rear side of said panel proximal to and extending towards a first side edge and together with said first side edge defining a pair of discontinuous grooves;

a pair of tongues extending from a second side edge;

said grooves structured and arranged for receiving said tongues of a horizontally adjacent panel and said tongues structured and arranged for insertion into said grooves of a horizontally adjacent panel.

27. The siding panel of claim 23, wherein said apertures form an opening in said aperture ledge profiled to receive said downwardly depending tabs as inserted from above.

28. The siding panel of claim 23, wherein said decorative elements are set forward of said mounting strip as joined by said aperture ledge.

* * * * *